US008740003B2

(12) United States Patent
Elliott

(10) Patent No.: US 8,740,003 B2
(45) Date of Patent: Jun. 3, 2014

(54) DISPENSING CONTAINERS

(75) Inventor: Howard Elliott, Oxfordshire (GB)

(73) Assignee: Future Technology (UK) Ltd, Oxfordshire (GB)

( * ) Notice: Subject to any disclaimer, the term of this patent is extended or adjusted under 35 U.S.C. 154(b) by 0 days.

(21) Appl. No.: 13/820,929

(22) PCT Filed: Sep. 26, 2011

(86) PCT No.: PCT/GB2011/001390

§ 371 (c)(1), (2), (4) Date: May 24, 2013

(87) PCT Pub. No.: WO2012/049447

PCT Pub. Date: Apr. 19, 2012

(65) Prior Publication Data

US 2013/0299499 A1 Nov. 14, 2013

(30) Foreign Application Priority Data

Oct. 15, 2010 (GB) ..... 1017433.2

(51) Int. Cl.
*B65D 77/20* (2006.01)
*B65D 75/32* (2006.01)

(52) U.S. Cl.
CPC ..... *B65D 77/2028* (2013.01); *B65D 75/327* (2013.01); *B65D 77/2024* (2013.01); *B65D 75/325* (2013.01)
USPC ..... 220/359.4; 220/359.3; 220/507; 206/538

(58) Field of Classification Search
CPC ..... B65D 77/2028; B65D 77/2024; B65D 77/20; B65D 17/502; B65D 75/327; B65D 75/325; B65D 75/32; B65D 75/30
USPC ..... 220/359.3, 359.4, 359.1, 507, 526, 524, 220/523, 500; 206/531, 532, 538, 539; 53/471, 478, 477, 476; 156/69
See application file for complete search history.

(56) References Cited

U.S. PATENT DOCUMENTS 3,783,089 A * 1/1974 Hurst et al. ..... 220/359.3
5,318,824 A * 6/1994 Itaya et al. ..... 428/178

(Continued)

FOREIGN PATENT DOCUMENTS

CA 2 538 623 A1 9/2007
EP 1 357 050 A1 10/2003
EP 1357051 A1 * 10/2003 ..... B65D 75/34

(Continued)

OTHER PUBLICATIONS

International Search Report for PCT/GB2011/001390, dated Dec. 8, 2011 (3 pages).

*Primary Examiner* — Robert J Hicks
(74) *Attorney, Agent, or Firm* — Kilyk & Bowersox, P.L.L.C.

(57) ABSTRACT

A dual-purpose seal is provided that forms part of a container for storing and dispensing consumer products. The container can be used in place of conventional blister packs for the packaging of pills, tablets, or capsules or in place of conventional multi-cavity containers for organizing and storing mixed medication for subsequent dispensing according to a predefined dosage regimen. The container includes a tray having a generally planar top surface into which has been formed one or more discrete cavities. The seal includes a cover film having pre-formed lines of separation defining a removable portion, and a barrier film that is secured to the cover film by a layer of peelable adhesive. The barrier film has pre-formed lines of separation defining a barrier patch. The barrier film also includes a heat-sealing adhesive such that the dual-purpose seal can be adhered to the tray in two different ways.

20 Claims, 5 Drawing Sheets

(56) References Cited

U.S. PATENT DOCUMENTS

| | | | | |
|---|---|---|---|---|
| 5,783,273 | A * | 7/1998 | Yamamoto et al. | 428/35.9 |
| 5,785,180 | A * | 7/1998 | Dressel et al. | 206/532 |
| 5,833,071 | A * | 11/1998 | Ray | 206/532 |
| 6,776,285 | B2 * | 8/2004 | Shibata | 206/469 |
| 2004/0060845 | A1 | 4/2004 | Ito et al. | |

FOREIGN PATENT DOCUMENTS

| | | | | |
|---|---|---|---|---|
| EP | 1695921 | A2 * | 8/2006 | B65D 75/34 |
| WO | 2005023670 | A1 | 3/2005 | |

* cited by examiner

DISPENSING CONTAINERS

FIELD OF THE INVENTION

The invention relates to containers for storing and dispensing consumer products. The term consumer products is intended to cover a wide variety of products as illustrated by the following (non-exhaustive) list: foods, either for immediate consumption, pre-cooked, prepared or oven ready, including prepared meals, confectionary, hardware and DIY items, cosmetics, seeds, animal and fish feeds, electronic components, medical appliances and dressings, medicines and medication such as pills, tablets and capsules.

The containers may be used in place of conventional blister packs for the packaging of pills, tablets and capsules, or may be used for organising and storing mixed medication for subsequent dispensation according to a predefined dosage regimen. The principle behind such mixed medication containers is that a dosage regimen of mixed medication can be organised in advance for a period of a week or more, and a patient or nurse can then remove from the container, at predefined times over the said period, the one or more pills, tablets and/or capsules to be administered on each occasion according to the dosage regimen.

BACKGROUND ART

Blister packs are of course well known for the storage and dispensing of pills, tablets and capsules, which are stored individually in cavities in a multi-cavity tray and removed by pushing each pill, tablet or capsule through a rupturable film or foil covering the cavities. The film or foil cover may be paper or a plastics film that can be peeled or torn away to expose the medication in the tray cavities, but is generally aluminium foil, which has the dual advantage of being easily rupturable and vapour-impermeable. Such blister packs normally carry only one unit dose of the same medication in each cavity.

Mixed medication blister packs have been proposed, having larger cavities for filling by a pharmacist, wherein each cavity in a multi-cavity tray can be filled with a mixture of medications. Typically, a tray may have a 2×7, 3×7, 4×7 or 5×7 array of cavities corresponding to 2, 3, 4 or 5 predefined medication times per day over a 7-day period, or one dose prescribed per day over a 2, 3, 4 or 5 week period. For example, a 4×7 tray may be filled with the medication to be taken at breakfast-time, lunchtime, early evening and immediately before retiring each day for a week, and then the filled cavities sealed with a rupturable or sequentially rupturable film or foil cover. Printed instructions on the pack identify the intended sequence of opening the individual cavities to dispense their contents according to the prescribed dosage regimen.

Disadvantages of conventional blister packs using a rupturable cover sheet are the difficulty experienced by some patients, particularly the elderly, in pushing the medication through the cover sheet, the need for expensive laminating equipment to seal the aluminium cover sheet over the cavities after the initial filling, and the difficulty experienced by the user in selecting the cavity containing the medication to be dispensed if the medication is pushed up through the foil from below. If the wrong cavity is opened by mistake then resealing is impossible because the cover sheet has ruptured.

A major disadvantage of the blister pack using a peelable cover sheet is the difficulty experienced by the user in peeling or tearing away a single selected portion of the cover sheet to expose the contents of only one preselected cavity. This can be achieved by scraping a finger-nail over a corner or tab portion of a segment of the cover sheet sealing the preselected cavity, but grasping that corner to peel away the complete segment sometimes requires considerable manual dexterity and possibly good eyesight, which is beyond the abilities of many elderly users. Also, if a tacky peelable adhesive is used to adhere the cover sheet to the tray, it is desirable to prevent the contents of the tray from coming into contact with the adhesive. Finally, the film cover sheet may not have as high a vapour impermeability as metal foil, so there is a reluctance on the part of pharmacists to pre-fill a mixed medication blister pack with medication for administration more than seven days in advance of the filling date, lest the medication deteriorates due to storage in humid ambient conditions.

WO 2005/023670 to the present Applicant describes a container that aims to overcome some or all of the above problems and disadvantages. The container is for storing and dispensing consumer products and includes a tray having a generally planar top surface into which has been formed one or more discrete cavities for receiving the consumer products. A cover film is adhered to the generally planar top surface of the tray by a layer of peelable adhesive to seal the one or more cavities to retain the consumer products in the one or more cavities. The cover film has pre-formed tear lines defining a tear-off portion per cavity to retain the consumer products in that cavity until it is removed by tearing along its tear lines. In practice it will be readily appreciated that the or each tear-off portion can also be defined by cut lines extending completely through the material of the cover film. The or each tear-off portion of the cover film has low vapour transmission properties in the area which in use overlies the associated cavity, those low vapour transmission properties being created by a barrier patch with high vapour barrier properties shaped and sized to overlie the associated cavity. The or each barrier patch is adhered to the underside of the cover film by the same layer of peelable adhesive as that which adheres the cover film to the top surface of the tray.

The barrier patch beneath the or each tear-off portion can be created from a single sheet of barrier film as follows. A single sheet of barrier film is secured to the underside of the cover film by a peelable adhesive. The barrier film has pre-formed tear-lines defining the periphery of the or each vapour-resistant barrier patch so that peeling away the majority of the barrier film from the cover film immediately prior to application of the cover film to secure it to the generally planar top surface of the tray exposes the peelable adhesive in areas necessary for adhesion to the tray but leaves a barrier patch attached to the underside of the or each tear-off portion of the cover film. In practice it will be readily appreciated that the or each barrier patch can also be defined by cut lines extending completely through the material of the barrier film.

The sheet of barrier film can have a further pre-defined tear line (or cut line) close to one edge thereof to define a tear-off strip which when removed exposes a location anchorage area of the peelable adhesive on the underside of the cover film, for adhering an edge portion of the cover film to an edge portion of the tray before peeling away the majority of the barrier film and adhering it over the cavities. To assist in the process of adhering the cover film to the top surface of the tray, the tray can have upstanding cover film location means. The cover film can have cooperating means for accurate location of the cover sheet over the tray with the one or more cavities and associated tear-off portions in register before adhering the cover film to the tray.

A similar container is described in EP 1357050 to the present Applicant but in this case each tear-off portion of the cover film includes a lug portion that overlies the generally planar top surface of the tray and which can be readily grasped by the user. The top surface of the tray includes upwardly extending protrusions that are located beneath the or each lug portion in use to bend that lug portion upwardly out of the plane of the remainder of the cover film.

It will be readily appreciated that WO 2005/023670 and EP 1357050 describe a "cold seal" process where the cover film is secured to the tray by the same layer of peelable adhesive that is used to secure the cover film to the barrier film.

After the majority of the barrier film has been peeled away from the cover film to expose the peelable adhesive, the cover film can be secured manually to the top surface of the tray. The cover film can also be secured to the tray using an industrial "cold seal" process. A typical process might involve securing the cover film to the tray using a high-speed, on-line sealing apparatus. This will normally require the laminated seals (i.e. the combination of the cover film and barrier film) to be supplied as a continuous reel and the automatic application of the cover film to the tray requires the surplus barrier film to be removed during the sealing process. The barrier film therefore has to be wound onto a waste cylinder or placed in a waste container before being recycled. In the case of the seals described in EP 1357050 the action of securing the cover film to the tray causes the lug portions to be bent upwardly out of the plane of the remainder of the cover film by the upwardly extending protrusions. This can be difficult to implement properly using an industrial "cold seal" process.

SUMMARY OF THE INVENTION

The present invention aims to overcome some or all of the above problems and disadvantages that arise from the use of an industrial "cold seal" process and provides an improved seal for use with a container for storing and dispensing consumer products comprising a tray having a generally planar top surface into which has been formed one or more discrete cavities for receiving the consumer products, the seal comprising: a cover film to seal the one or more cavities to retain the consumer products in the one or more cavities, the cover film having pre-formed lines of separation defining a removable portion per cavity to retain the consumer products in that cavity until it is removed along its line of separation; and a barrier film releasably secured to the cover film by a layer of peelable adhesive, the barrier film having pre-formed lines of separation defining the periphery of a barrier patch per removable portion that is shaped and sized so that in use it overlies an associated cavity; wherein at least a part of the planar surface of the barrier film that in use will be placed in contact with the generally planar top surface of the tray is coated with a heat-sealing adhesive that is activated to secure the barrier film to the generally planar top surface of the tray when heat is applied.

Because the barrier film is secured to the cover film by a layer of peelable adhesive then the seal can still be secured to the tray using a conventional "cold seal" process where the majority of the barrier film is peeled away to expose the peelable adhesive. However, the improved seal is a "dual-purpose" seal and, unlike the seals described in WO 2005/023670 and EP 1357050, the barrier film can be adhered directly to the tray using a "heat seal" process where the heat-sealing adhesive coating is activated. The individual applying the seal has the option to either secure the cover film to the top surface of the tray using the layer of peelable adhesive or to secure the barrier film to the top surface of the tray using the "heat seal" process.

Securing the seal to the tray using the "heat seal" process means that a sealing apparatus for industrial application can have a much simpler design because there is no need for the barrier film to be removed from the cover film during the sealing process. The seals may also be supplied to the sealing apparatus in sheet form (i.e. as individual sheets that can be fed manually or stacked into an automatic feeding mechanism) rather than as a continuous reel. This is particularly advantageous because a continuous reel has be to fed through a complex system of rollers and guides and if not properly aligned this can lead to increased downtime of the sealing apparatus and other operational difficulties.

The periphery of the or each removable portion can be defined by a pre-formed cut line extending completely through the material of the cover film, a pre-scored or pre-perforated tear line, or any combination thereof. Similarly, the periphery of the or each bather patch can be defined by a pre-formed cut line extending completely through the material of the barrier film, a pre-scored or pre-perforated tear line, or any combination thereof. The pre-scored tear lines may be created by pressing a knife on to the surface of the cover film or barrier film so as to cut or score part way through but not fully through the thickness of the cover film or barrier film.

The depth of the pre-scored tear lines or the size and shape of the individual perforations of the pre-perforated tear lines can be determined to provide the right amount of resistance to separation for any given application. Increasing the resistance to separation can reduce the likelihood of the removable portions being removed accidentally or being pushed into the discrete cavities of the underlying tray if, for example, dispensing containers are stacked one on top of the other. The pre-scored tear lines, pre-perforated tear lines and cut lines can be formed using a rotary die cutter or the like.

The line of separation defining the or each removable portion can extend completely around the periphery of the associated cavity, and only within the periphery of the associated barrier patch. Alternatively, the or each removable portion can be attached to the remainder of the cover film by a bridge region such that the associated line of separation does not extend completely around the periphery of the associated cavity. The removable portion will therefore remain attached to the cover film after it has been released and the contents of the cavity have been dispensed. This arrangement is considered to be more environmentally friendly because the individual removable portion and associated barrier patch do not have been discarded each time the contents of a cavity are dispensed.

In a preferred arrangement of the invention, the pre-formed line of separation defining the periphery of the or each barrier patch lies outside the pre-formed line of separation defining the periphery of the overlying removable portion such that the barrier patch is larger than the associated removable portion. In this case the barrier patch can overly a narrow border or region of the generally planar top surface of the tray extending completely around the periphery of the associated cavity in use. The barrier patch must also be peeled away from a narrow border of the cover film immediately outside the line of separation defining the periphery of the removable portion when the overlying removable portion is released. If the pre-formed line of separation defining the periphery of the or each removable portion is a cut line extending completely through the material of the cover film around the whole of the periphery of the removable portion then there is no physical connection between the individual removable portion and the remainder of the cover film. The individual removable portion will therefore normally be held in position within the plane of the remainder of the cover film by the associated larger barrier patch to which it is adhered. It is important to note that the or each barrier patch is not secured to the top surface of the tray, but only to the cover film. For the avoidance of any doubt, it should be noted that the or each barrier patch may be larger than, the same size as, or smaller than the associated removable portion and may be shaped and sized to be larger than, the same size as, or smaller than the associated cavity of the tray.

The preferred arrangement may incorporate tamper evident properties because once a removable portion of the cover film has been released it cannot be easily reattached over the associated cavity. This is because the barrier patch is larger than the overlying removable portion such that in use it overlies a region of the generally planar top surface of the tray extending completely around the periphery of the associated cavity. Once the removable portion and the attached barrier patch have been released, there will be a narrow border of the cover film immediately outside the line of separation defining the periphery of the removable portion. It will be readily appreciated that this narrow border is secured to the periphery of the barrier patch prior to the release of the removable portion. In practice, because the underside of the cover film is covered with peelable adhesive, the narrow border will tend to adhere to the generally planar top surface of the tray. This makes it very difficult to slide the peripheral edge of the barrier patch back between the cover film and the top surface of the tray to reattach the released removable portion over the associated cavity. Tamper evident properties are especially important if the container is used to store and dispense food and medication such as pills, tablets and capsules.

The or each removable portion of the cover film may include an associated lug portion as described in EP 1357050. In this case the top surface of the tray will preferably have an upwardly extending protrusion positioned to be located beneath the or each lug portion in use to bend that lug portion upwardly out of the plane of the remainder of the cover film. Because the or each lug portion is bent up out of the plane of the remainder of the cover film when the seal is adhered or secured to the tray it can very easily be grasped by the consumer for removal of the associated removable portion. Each barrier patch may optionally extend underneath the lug portion of the associated removable portion. Any part of the barrier patch that extends underneath the lug portion will also be bent upwardly out of the plane of the remainder of the barrier film when the seal is secured to the tray.

The upstanding protrusion may slope upwardly from the plane of the top surface of the tray in a direction away from the associated cavity.

It will be readily appreciated that the removable portions and barrier patches may have any suitable size, shape and general configuration and are defined by the pre-formed lines of separation formed in the cover film and barrier film, respectively.

The barrier film can have a further pre-defined cut line or tear line close to one edge thereof to define a removable strip which when removed exposes a location anchorage area of the peelable adhesive on the underside of the cover film, for adhering an edge portion of the cover film to an edge portion of the tray before peeling away the majority of the barrier film and adhering the cover film over the cavities. To assist in the process of adhering the cover film to the top surface of the tray, the tray can have upstanding cover film location means. The cover film can have cooperating means for accurate location of the cover sheet over the tray with the one or more cavities and associated removable portions in register before adhering the cover film to the tray. Where the barrier film is to be secured to the top surface of the tray, the tray can have upstanding seal location means. The seal can have cooperating means for accurate location of the seal over the tray with the one or more cavities and associated removable portions in register before adhering the barrier film to the tray.

The seal preferably has high vapour barrier properties, optionally by selecting an appropriate material or thickness for the cover film and/or the barrier film. Providing low vapour permeability in the region that overlies the or more cavities means that medication temporarily encapsulated in the cavities can be protected from variations in ambient humidity during storage of the medication within the container. Low vapour permeability is also important if the container is used to store and dispense consumer products such as foods or electronic components that can perish or suffer damage if too much moisture is allowed to enter the discrete cavities through the seal. It will, however, be recognised that the seal may be provided with other selected barrier properties such as light barrier properties or gas barrier properties to reduce or prevent the transmission of light or atmospheric gases such as oxygen, for example. The seal may also be provided with electrostatic barrier properties.

The cover film may have pre-formed lines of separation defining an array of removable portions. The barrier film may also have pre-formed lines of separation defining an array of barrier patches, each barrier patch being associated with a removable portion and being shaped and sized so that in use it overlies one of the cavities.

The cover film may be a metal foil, such as aluminium foil, a metallized polymeric film or paper sheet, a plastics film of single or multiple layer construction, or any combination thereof, depending on the sort of consumer products to be stored and dispensed from the container. The cover film is preferably non-rupturable (except around pre-formed tear lines) so that the consumer products cannot be accidentally or deliberately pushed through the cover film.

The barrier film may be a metal foil, such as aluminium foil, a metallized polymeric film or paper sheet, a plastics film of single or multiple layer construction, or any combination thereof, depending on the sort of consumer products to be stored and dispensed from the container.

The present invention further provides a method of applying a seal as described above to a container for storing and dispensing consumer products comprising a tray having a generally planar top surface into which has been formed one or more discrete cavities for receiving the consumer products, the method comprising the steps of: locating the seal over the generally planar top surface of the tray so that the or each barrier patch overlies an associated cavity; and securing the barrier film to the generally planar top surface of the tray by applying heat to activate the heat-sealing adhesive. It will be readily appreciated that the same seal could also be applied to the container using a conventional "cold seal" process where the majority of the barrier film is peeled away to expose the peelable adhesive.

The heat-sealing adhesive or coating is applied to the planar surface of the barrier film that will be placed in contact with the top surface of the tray. The adhesive will preferably be a lacquer which is dry to touch and will adhere the barrier film to the top surface of the tray when heat is applied. The adhesive may be applied to the entire planar surface of the barrier film or only to those areas where it is needed to adhere the barrier film to the tray. For example, standard printing techniques can be used to apply a pattern of adhesive on to the planar surface of the barrier film. Alternatively, the adhesive may be applied to the generally planar top surface of the tray.

An example of a suitable heat-sealing adhesive would be UV Flexo general purpose adhesive (product code UVH01001) supplied by Flint Group Narrow Web of Trelleborg, Sweden.

If the barrier film has pre-formed lines of separation defining an array of barrier patches then the adhesive can be applied only in the regions between the barrier patches. This is particularly important if the barrier patches are shaped and sized to overlie a narrow border or region of the generally planar top surface of the tray. In this case there can be at least a narrow border or region around each barrier patch where adhesive is not applied to make sure that the barrier patches are not accidentally adhered to the top surface of the tray.

The seal can be heated directed using a heat-heating element, or indirectly by a suitable ultrasonic or radio frequency (RF) heating process, for example. The application of heat may be localised. More particularly, in the case where the heat-sealing adhesive is applied to the entire planar surface of the barrier film then the application of a suitably shaped heat-sealing element may activate the adhesive only in those areas where the heat-sealing element contacts the seal. The barrier film will therefore be adhered to the tray only in those areas where the seal has been heated sufficiently to activate the heat-sealing adhesive. If the barrier film has pre-formed lines of separation defining an array of barrier patches then the adhesive will preferably only be activated in the regions between the barrier patches.

It will be readily appreciated that care must be taken if heat is applied to the seal to ensure that the physical integrity of the or each removable portion and the associated barrier patch is not compromised because this will have a significant effect on seal performance. Parameters that may need to be properly selected for the appropriate "heat seal" process might include the heat seal temperature, the dwell time (e.g. how long the heat-sealing element is applied to the seal), the pressure of the heat seal (e.g. the pressure applied by the heat-sealing element to the seal), and the melting point, heat stability, fluidness and thickness of the heat-sealing adhesive.

The heat-sealing adhesive may be applied to the barrier film either before or after the cut lines or tear lines are formed in the barrier film.

The container to which the seal is adhered can be a multiple-compartment container for containing and dispensing medication according to a pre-defined dosage regimen, wherein an array of discrete cavities are formed into the generally planar top surface of the tray. The seal can be printed with details of the sequence of the dosage regimen, so that the user can determine the correct sequence of opening and can release the individual removable portions. The individual removable portions of the cover film are released with the generally planar top surface of the tray facing upwards, so that the risk of spilling the medication onto the floor during opening is much reduced over rupturable foil covered blister packs which are generally opened in the inverted position.

To dispense the contents of a cavity, the consumer simply pushes down on the associated removable portion with their forefinger. This may require the consumer to release the removable portion from the remainder of the cover film by tearing along the tear lines. In an arrangement where the underlying barrier patch is larger than the associated removable portion then it must also be peeled away from the overlapping region of the cover film. The force needed to release the removable portion is preferably less than is necessary to push the consumer products through a rupturable cover sheet.

The released removable portion is then pushed down into the cavity on top of the consumer products and can be removed through the newly created opening in the cover film by sliding it up the side of the cavity until it can be grasped firmly between forefinger and thumb. Alternatively, if the tray is formed from a suitable (preferably plastics) material such that the one or more cavities are compressible, the contents of a cavity can be dispensed by pushing the consumer products through the cover film from behind.

If each removable portion includes a lug portion as described in EP 1357050 then the contents of a cavity can be dispensed by grasping the lug portion and removing the associated removable portion and barrier patch.

The present invention further provides a container for storing and dispensing consumer products comprising: a tray having a generally planar top surface into which has been formed one or more discrete cavities for receiving the consumer products; and a seal comprising: a cover film to seal the one or more cavities to retain the consumer products in the one or more cavities, the cover film having pre-formed lines of separation defining a removable portion per cavity to retain the consumer products in that cavity until it is removed along its line of separation; and a barrier film releasably secured to the cover film by a layer of peelable adhesive, the barrier film having pre-formed lines of separation defining the periphery of a barrier patch per removable portion that is shaped and sized so that in use it overlies an associated cavity; wherein the barrier film is secured to the generally planar top surface of the tray with a heat-sealing adhesive.

Further details of the dispensing container and seal are as described above.

DRAWINGS

Although the dispensing container according to the invention is suitable for storing and dispensing a wide range of consumer products, the rest of the specification will concentrate mainly on its use as a multiple-compartment container for organising and storing mixed medication for subsequent dispensation according to a predefined dosage regimen.

Figure 1:
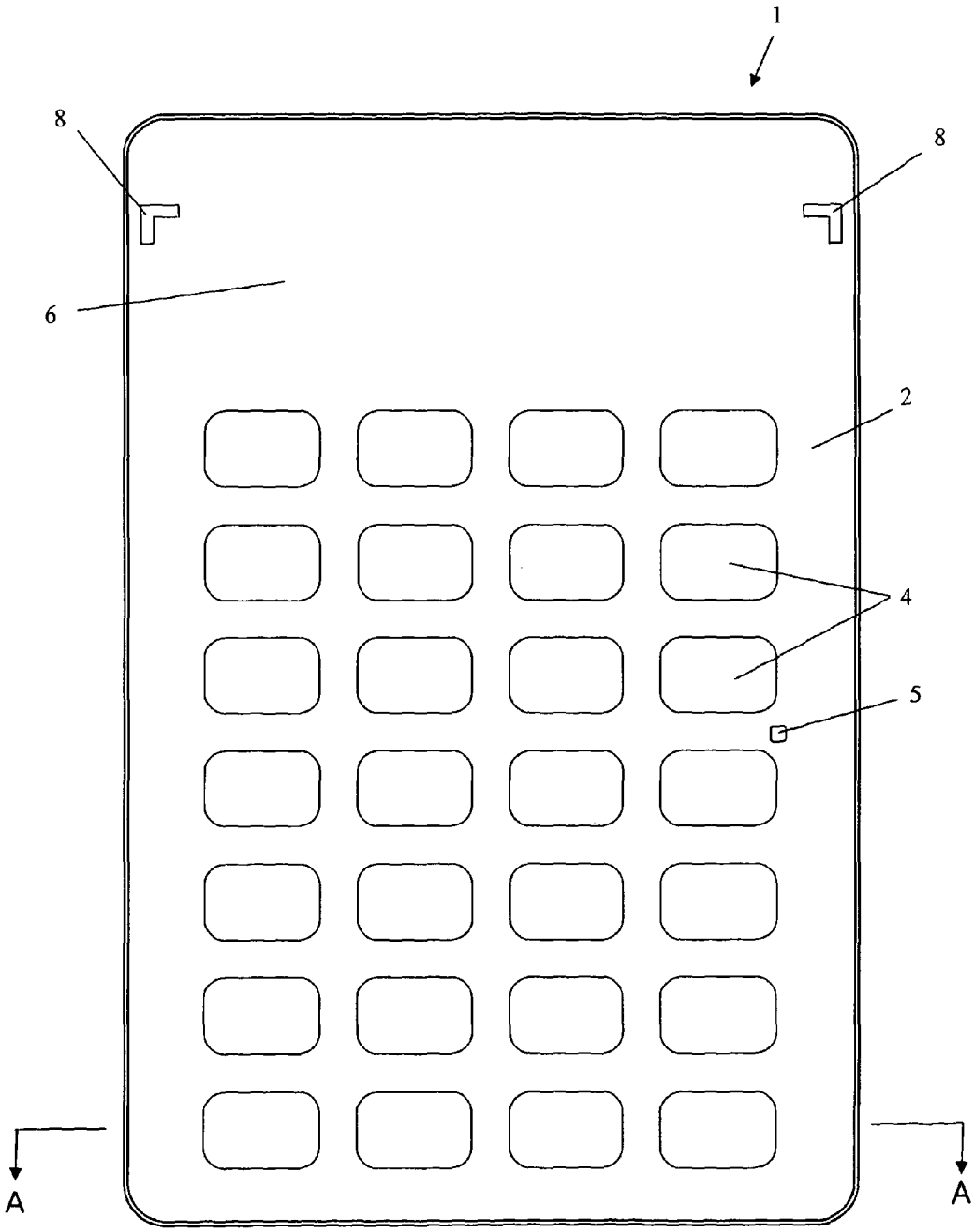
FIG. 1 is a top view of a moulded tray of a multiple-compartment dispensing container.
Figure 2:
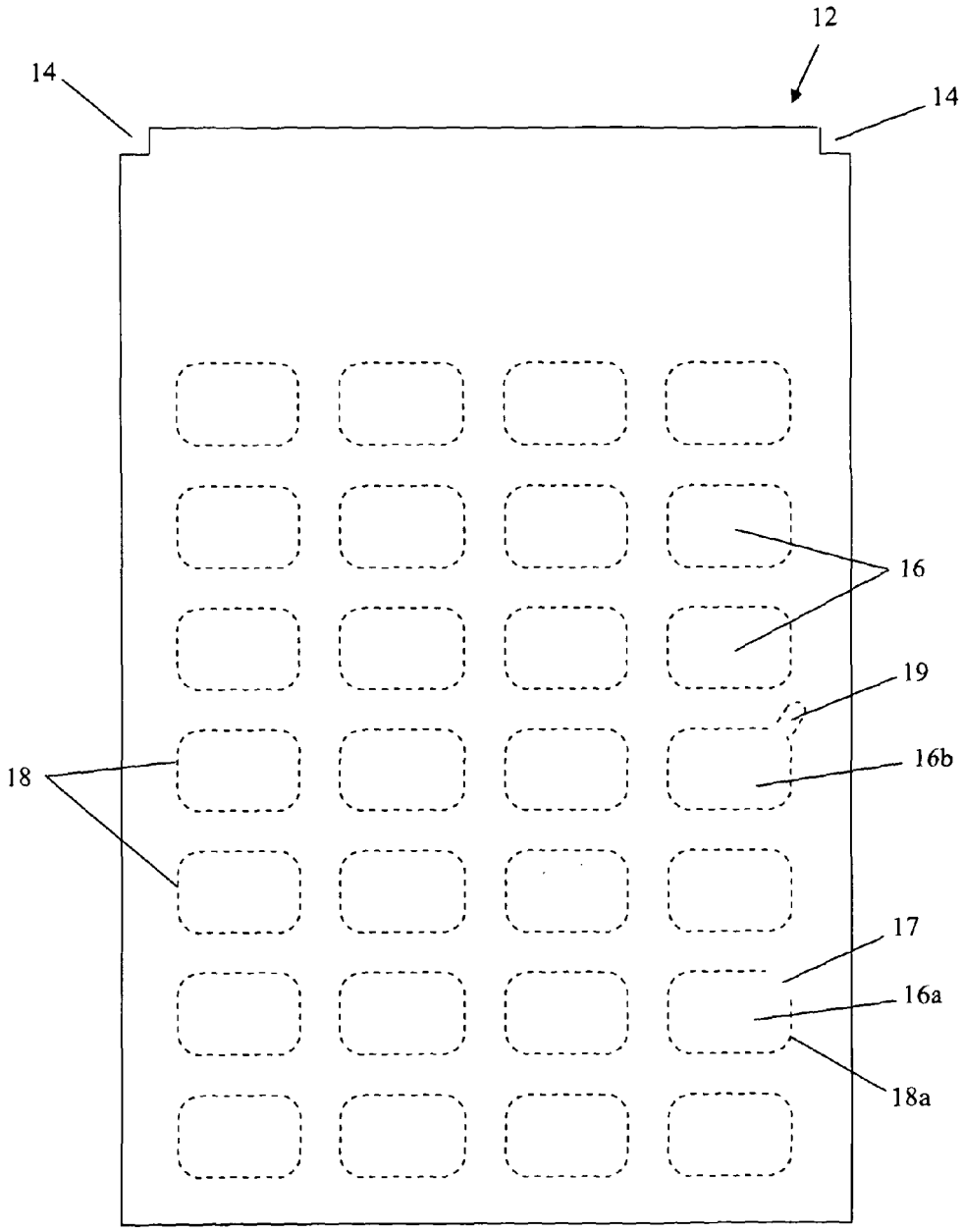
FIG. 2 is a plan view of a cover film.

Referring to FIG. 1 there is shown a moulded tray 1 for use in the creation of a multiple-compartment container. The tray 1 is formed from a sheet of thermoplastic material, and may be formed for example by press moulding or by vacuum moulding. The tray 1 has a generally planar top surface 2 into which has been formed a 4×7 array of discrete cavities 4. It will be readily appreciated that other arrangements of the discrete cavities are possible depending on the particular dosage regimen required.

A flat header portion 6 immediately above the array of cavities 4 is provided for receiving printed information such as a trade mark or a pharmacy label. However, in other arrangements this header portion may be omitted completely and the cover film and barrier film will be sized and shaped accordingly. Close to the top corners of the header portion 6 the tray is provided with two upstanding integrally moulded location brackets 8 for the accurate location of a seal 10 in register with the cavities 4.

The seal 10 is of a laminated construction, which can be best understood by reference to FIGS. 2 to 5. The top layer of the seal is the cover film 12 shown in FIG. 2. It is a sheet of smooth and flexible, and preferably transparent, plastics film, the outline of which corresponds generally to the outline of the tray 1 with which it is to be used. A suitable material for the cover film 12 is polypropylene. A pair of location rebates 14 formed in the cover film 12 cooperate with the location brackets 8 for the accurate location of the seal on the tray 1 in precise alignment one with the other.

The cover film 12 includes a 4×7 array of tear-off portions 16 each of which is defined by perforations 18 that extends completely around the periphery of an underlying cavity 4 in the moulded tray 1 when the seal is adhered to the top surface 2 of the tray 1. The perforations represent predefined zones of weakness in the cover film 12. For the purposes of illustration, one tear-off portion 16*a* is defined by a perforation 18*a* that does not extend completely around the periphery of an underlying cavity 4. The ends of the perforation 18*a* are separated by a bridge region 17 so that the tear-off portion 16*a* remains attached to the cover film 12 even when the perforation 18*a* is torn. Also for the purposes of illustration, one tear-off portion 16*b* includes a lug portion 19 as described in EP 1357050. An upwardly extending protrusion 5 is located beneath the lug portion 19 to bend the lug portion upwardly out of the plane of the remainder of the cover film 12 when the seal is adhered to the top surface 2 of the tray 1.

Figure 4:
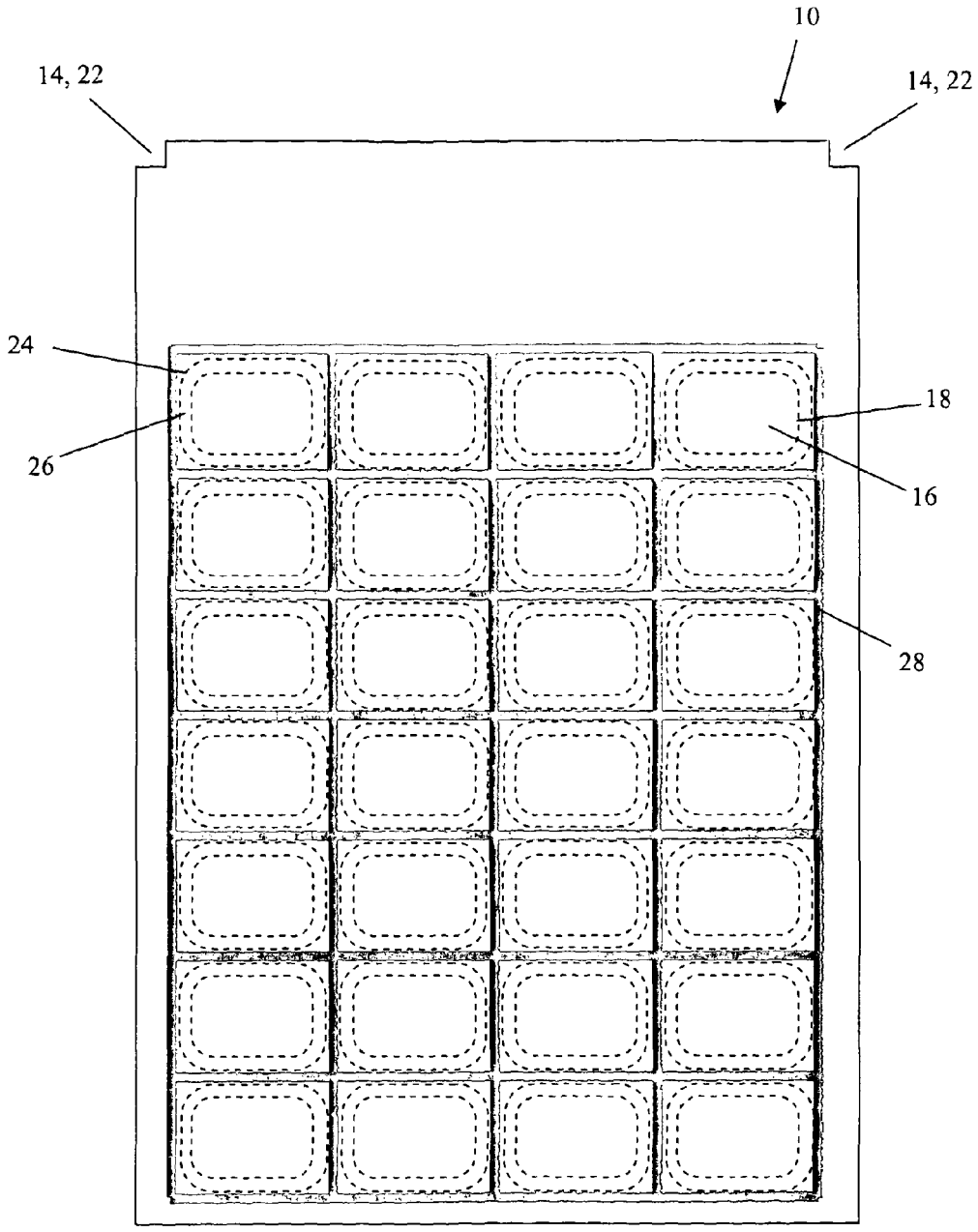
FIG. 4 is a plan view of a seal according to the invention where the cover film of FIG. 2 has been secured to the barrier film of FIG. 3.
Figure 5:
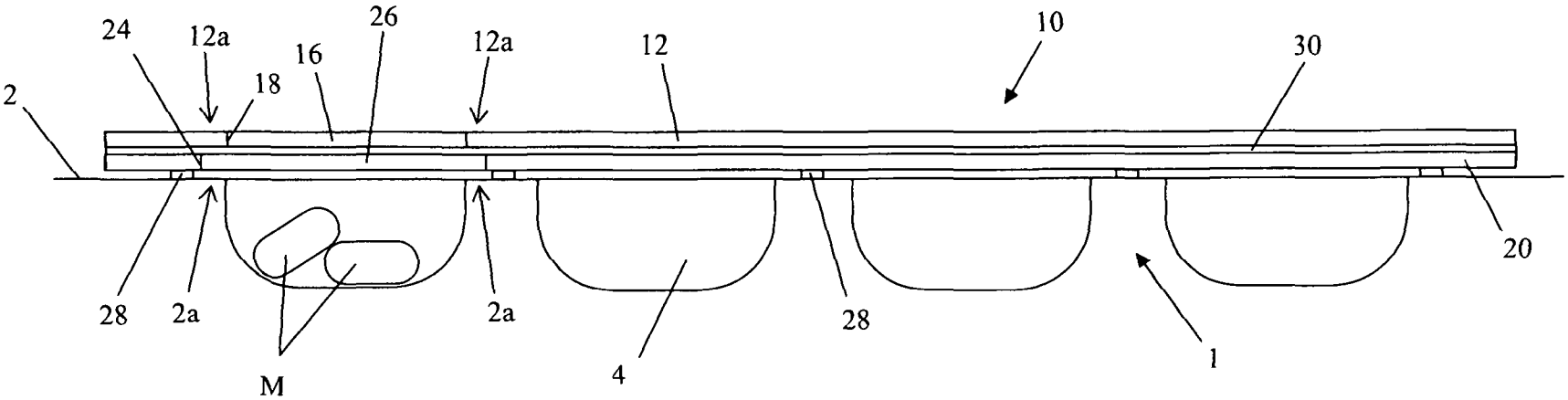
FIG. 5 is a cross section view of the moulded tray of FIG. 1 taken along line A-A in combination with the seal of FIG. 4.

The entire underside of the cover film 12 is coated with a layer of peelable adhesive 30 and is adhered to a bather film 20 shown in FIGS. 4 and 5. The bather film 20 is a sheet of smooth and flexible, and preferably transparent, plastics film, the outline of which corresponds generally to the outline of the cover film 12 with which it is to be used. A suitable material for the barrier film 20 is polypropylene.

The barrier film 20 has a two location rebates 22 that register with the location rebates 14 of the cover film 12. Perforations 24 define the outer peripheries of a 4×7 array of vapour-impermeable barrier patches 26, which in use are adhered to the underside of the respective tear-off portions 16 and lie directly over the respective cavities 4 of FIG. 1. The barrier patches 26 are slightly larger than the tear-off portions 16 such that in use they overly a region of the generally planar top surface 2 of the tray 1 extending completely around the periphery of the respective cavities 4. However, the barrier patches may be the same size as, or smaller than, the tear-off portions 16. Although not shown, if the tear-off portions include a lug portion as described in EP 1357050 then the barrier patches may extend at least partly underneath the lug portions.

It will be readily appreciated that the perforations 18, 18*a* in the cover film 12 can be replaced with cut lines that extend completely through the cover film material, or by score lines. Similarly, the perforations 24 in the barrier film 20 can be replaced with cut lines that extend completely through the barrier film material, or by score lines. The cut lines or tear lines will normally be formed using a die cutter after the cover film 12 and the barrier film 20 have been secured together to form the laminated seal 10. A pair of rotary die cutters can be used with one die cutter forming cut lines or tear lines in the cover film 12 from one side of the seal 10 and the other die cutter forming cut lines or tear lines in the barrier film 20 from the other side of the seal. In the case of cut lines or perforation lines, care must be taken to ensure that the overall physical integrity of the seal is maintained. For example, in practice it will often be the case that the cut lines or perforations formed in the cover film 12 will extend slightly into the layer of peelable adhesive 30, but the respective rotary die cutter is preferably set such that the cut lines or perforation lines do not extend into the barrier film 20 to any appreciable extent.

In use, a pharmacist or a carer, or the patient himself or herself will distribute medication in the form of pills, tablets and/or capsules between the 28 discrete cavities 4 formed in the top surface 2 of the tray 1 in accordance with a seven-day or 28-day dosage regimen. For example, the seven rows of cavities represent the days of the week, and the four columns can represent either four consecutive weeks of a 28-day dosage cycle, or four different dosage times for each day of treatment. In the latter case, the first column can represent breakfast-time, the second column lunchtime, the third column early evening and the fourth column bedtime. Either a uniform medication can be distributed through the 28 discrete cavities, or a varying mixture of medications can be placed into each cavity.

When the cavities 4 have been properly filled the seal 10 is secured to the top surface 2 of the tray.

Figure 3:
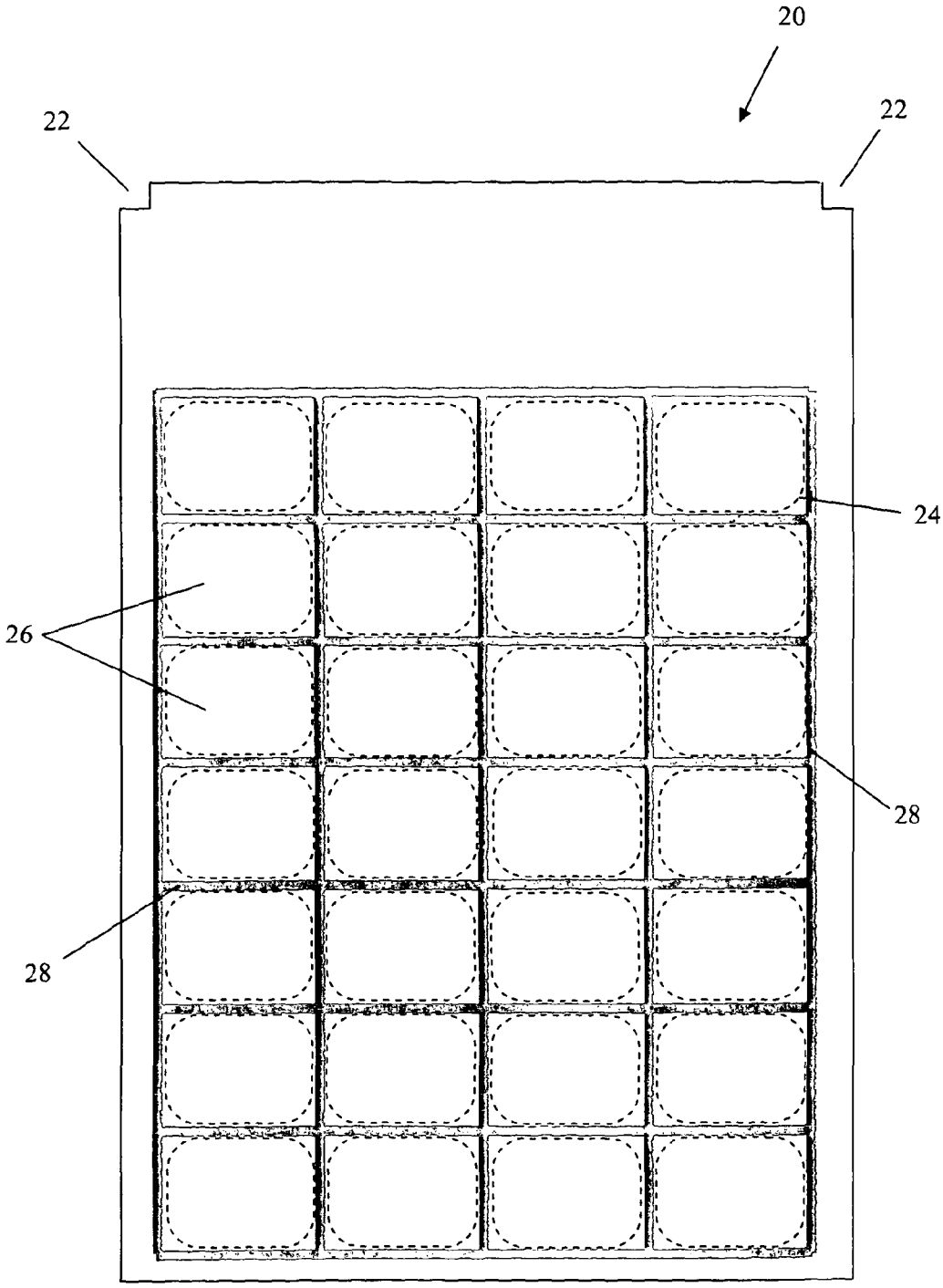
FIG. 3 is a plan view of a barrier film to be used in conjunction with the cover film of FIG. 2 to form a seal according to the invention.

FIGS. 3 and 4 show that a pattern of heat-sealing adhesive 28 is applied to the outer surface of the barrier film 20 that will be placed in contact with the top surface 2 of the tray 1. The adhesive 28 is applied only to those areas that are outside the barrier patches 26. However, in practice the heat-sealing adhesive can be applied to the entire outer surface of the barrier film 20.

The seal 10 is placed on top of the tray 1 with the location rebates 14, 22 adjacent the location brackets 8 such that the tear-off portions 16 of the cover film 12 are in register with the cavities 4 formed in the tray. The barrier patches 26 of the barrier film 20 overlie a narrow border or region 2*a* of the generally planar top surface of the tray that completely surrounds each cavity 4.

A sealing apparatus (not shown) is then used to apply heat to the seal 10 to activate the heat-sealing adhesive 28 and adhere the barrier film 20 to the top surface 2 of the tray 1. If the heat-sealing adhesive is applied to the entire (or substantially the entire) outer surface of the barrier film then it can be selectively activated in certain areas by localised heating etc.

FIG. 5 shows the seal 10 secured to the top surface 2 of the tray 1 by the heat-sealing adhesive 28. Heat-sealing adhesive is spaced apart from the periphery of the barrier patches 26, which are therefore not secured to the top surface 2 of the tray 1.

FIG. 5 also show the relative location of the perforations 18 and 24 in the cover film 12 and barrier film 20 that define one of the tear-off portions and barrier patches.

The seal can also be adhered to the top surface 2 of the tray 1 by peeling away the majority of the barrier film 20 to expose the layer of peelable adhesive 30. The barrier film 20 will tear around the barrier patches 26, which remain adhered to the underside of the cover film 12.

To dispense the medication M stored in one of the discrete cavities 4, the user simply presses down on the overlying tear-off portion 16. The application of a sufficient amount of force will cause the perforations 18 and 24 to tear such that the tear-off portion 16 and underlying barrier patch 26 are released from the remainder of the cover film 12 and barrier film 20, respectively. During the process of releasing the tear-off portion 16, the periphery of the underlying barrier patch 26 will be peeled away from the narrow border or region 12*a* of the cover film 12 that surrounds the periphery of the tear-off portion. Once released, the tear-off portion and barrier patch can be pushed down into the cavity 4 on top of the medication M. The tear-off portion 16 and barrier patch 26 are easily removed through the newly created opening in the seal 10 by sliding them up the side of the cavity 4 until they can be grasped firmly between forefinger and thumb. The medication M can then be tipped out by inverting the multiple-compartment container or picked out by hand.

The tear-off portion 16*a* is released in the same way but stays attached to the remainder of the cover film 12 by the bridge region.

The medication M does not come into contact with any adhesive because the underside of each tear-off portions 16 is completely covered by a barrier patch 26.

Printed instructions to the user concerning the timing of the dosage regimen can be printed on the tray 1 (if the seal 10 is transparent) or on the seal 10. Similarly, printing to identify the manufacturer of the multiple-compartment container or the pharmacy, or the patient can be printed on the header portion 4 of the tray 1, or on the seal 10 which overlies that portion.

The invention claimed is:

1. A dual-purpose seal comprising:

a cover film having pre-formed lines of separation defining one or more removable portions; and a barrier film comprising an adhered surface, an exposed surface, and preformed lines of separation, the adhered surface being releasably secured to the cover film by a layer of a cold-seal peelable adhesive, the pre-formed lines of separation defining one or more barrier patches including one barrier patch per removable portion of the cover film, each barrier patch being aligned with an associated removable portion, the barrier film being configured to peel away from the cover film, except in areas defining the one or more barrier patches, to expose the cold-seal peelable adhesive on the cover film;

wherein at least a part of the exposed surface of the barrier film around the periphery of each barrier patch is coated with a heat-sealing adhesive.

2. The seal according to claim 1, wherein the periphery of each removable portion is defined by a pre-formed cut line extending completely through the cover film, a pre-scored or pre-perforated tear line, or any combination thereof.

3. The seal according to claim 1, wherein the periphery of each barrier patch is defined by a pre-formed cut line extending completely through the material of the barrier film, a pre-scored or pre-perforated tear line, or any combination thereof.

4. The seal according to claim 1, wherein each line of separation defining each removable portion extends only within the periphery of the associated barrier patch.

5. The seal according to claim 1, wherein each removable portion is attached to the remainder of the cover film by a bridge region defined by a gap in the associated line of separation.

6. The seal according to claim 1, wherein each barrier patch is larger than the associated removable portion.

7. The seal according to claim 6, wherein each barrier patch is configured to be peeled away from a narrow border of the cover film immediately outside the line of separation defining the periphery of the associated removable portion when the removable portion is released from the remainder of the cover film.

8. The seal according to claim 1, wherein each removable portion includes a lug portion.

9. The seal according to claim 8, wherein each barrier patch extends at least partially underneath a lug portion.

10. The seal according to claim 1, wherein the heat-sealing adhesive is spaced apart from the periphery of each barrier patch.

11. In combination, a container comprising a top surface and a plurality of cavities, and the seal according to claim 1, wherein each barrier patch is shaped, sized, and configured so that when the seal is placed on the top surface of the container and aligned with the plurality of cavities each barrier patch overlies a respective one of the plurality of cavities.

12. The seal according to claim 1, wherein the cover film is a metal foil, a metallized polymeric film or paper sheet, a plastics film of single or multiple layer construction, or any combination thereof.

13. The seal according to claim 1, wherein the barrier film is a metal foil, a metallized polymeric film or paper sheet, a plastics film of single or multiple layer construction, or any combination thereof.

14. The seal according to claim 1, wherein substantially the entire exposed surface of the barrier film is coated with the heat-sealing adhesive.

15. The seal according to claim 1, wherein the exposed surface of the barrier film is coated with a pattern of the heat-sealing adhesive.

16. A method of applying the seal according to claim 1, to a container, for storing and dispensing consumer products, comprising a tray having a generally planar top surface into which has been formed one or more discrete cavities for receiving the consumer products, the method comprising the steps of:

locating the seal over the generally planar top surface of the tray so that the or each barrier patch overlies an associated cavity and the exposed surface of the seal contacts the generally planar top surface; and securing the barrier film to the generally planar top surface of the tray by applying heat to activate the heat-sealing adhesive.

17. The method according to claim 16, comprising using a sealing apparatus to secure the barrier film to the generally planar top surface of the tray.

18. The method according to claim 17, further comprising manually moving the seal to the sealing apparatus.

19. The method according to claim 17, further comprising moving a plurality of seals to the sealing apparatus, sequentially, from a feeder unit.

20. A container for storing and dispensing consumer products, comprising:

a tray having a generally planar top surface into which has been formed one or more discrete cavities for receiving the consumer products;

consumer products in the one or more discrete cavities; and a dual-purpose seal comprising:

a cover film to seal the one or more cavities to retain the consumer products in the one or more cavities, the cover film having pre-formed lines of separation defining one or more removable portions including one removable portion per cavity, each of the one or more removable portions being configured to retain the consumer products in a respective one of the one or more cavities until the respective removable portion is removed along its line of separation; and a barrier film having a surface that is releasably secured to the cover film by a layer of a cold-seal peelable adhesive, and an opposite surface comprising a heat-sealing adhesive, the barrier film having pre-formed lines of separation defining one or more barrier patches including one barrier patch per removable portion of the cover film, each barrier patch being aligned with an associated removable portion and being shaped and sized so that it overlies a respective one of the one or more cavities;

wherein the barrier film is secured to the generally planar top surface of the tray with the heat-sealing adhesive.

* * * * *